US007525030B2

(12) United States Patent
Clark

(10) Patent No.: US 7,525,030 B2
(45) Date of Patent: Apr. 28, 2009

(54) ACOUSTIC GUITAR ASSEMBLY METHOD AND APPARATUS

(75) Inventor: Bradley Clark, Bayswater (AU)

(73) Assignee: Australian Native Musical Instruments Pty. Ltd., Victoria (AU)

( * ) Notice: Subject to any disclaimer, the term of this patent is extended or adjusted under 35 U.S.C. 154(b) by 321 days.

(21) Appl. No.: 10/554,977

(22) PCT Filed: Apr. 30, 2004

(86) PCT No.: PCT/AU2004/000560

§ 371 (c)(1),
(2), (4) Date: Dec. 28, 2005

(87) PCT Pub. No.: WO2004/097790

PCT Pub. Date: Nov. 11, 2004

(65) Prior Publication Data

US 2006/0096438 A1 May 11, 2006

(30) Foreign Application Priority Data

May 1, 2003 (AU) ..... 2003902087

(51) Int. Cl.
*G10D 3/00* (2006.01)

(52) U.S. Cl. ..... 84/290; 84/438

(58) Field of Classification Search ..... 84/290, 84/291, 293, 267, 173, 438
See application file for complete search history.

(56) References Cited

U.S. PATENT DOCUMENTS 2,649,827 A 8/1953 Maccaferri
2,743,644 A 5/1956 Rosenheim
3,443,466 A * 5/1969 Brakewell ..... 84/291
3,722,345 A 3/1973 Dopera

FOREIGN PATENT DOCUMENTS

GB 360401 5/1930
WO WO 2004/031697 A1 5/2004

OTHER PUBLICATIONS http://www.diynet.com/diy/hb_musical_instruments/article/0,2033,DIY_13881_2850588,00.html (downloaded Jun. 28, 2004), 3 pages.
http://www.trspartan.freeserve.co.uk/acoustic_guitars.htm Apr. 13, 2003 http://web.archive.org/*/http://www.trspartan.freeserve.co.uk/acoustic_guitars.htm (downloaded Jun. 17, 2004), 6 pages.

* cited by examiner

*Primary Examiner*—Walter Benson
*Assistant Examiner*—Jianchun Qin
(74) *Attorney, Agent, or Firm*—Patterson, Thuente, Skaar & Christensen, P.A.

(57) ABSTRACT

A method of assembling a musical instrument such as an acoustic guitar. The instrument includes at least one major panel and a side wall. The major panel has a groove or rebate cut into the panel according to a predetermined pattern, which may extend substantially around the periphery of the panel. A first assembly jig supports the panel whilst a second assembly jig holds the side wall in a configuration corresponding to the groove/rebate. The side wall is placed into the second jig such that a free edge of the side wall follows the groove/rebate. Adhesive is applied and the jigs are brought together such that the free edge of the side wall is inserted into the groove/rebate. A compression force is applied across the jigs to urge the side wall into the groove/rebate.

9 Claims, 11 Drawing Sheets

ACOUSTIC GUITAR ASSEMBLY METHOD AND APPARATUS

RELATED APPLICATION

This application claims priority to PCT Application No. PCT/AU2004/000560 filed Apr. 30, 2004, and Australian Patent Application No. 2003902087 filed May 1, 2003.

FIELD OF THE INVENTION

The present invention relates generally to musical instruments. The invention also relates to a method of making musical instruments and to apparatus intended to assist in the assembly of musical instruments. The invention is especially suited to the manufacture of acoustic guitars having a resonant body and a projecting neck component. It will therefore be convenient to describe the invention in relation to that example application but it should be understood that the invention is intended for broader application and use, including but not limited to bass, lap steel guitar, classical guitar, mandolin, violin, banjo, ukulele or dobro.

BACKGROUND OF THE INVENTION

There have been few major changes to the manner in which acoustic guitars are made since Martin guitars of the USA built the first steel string acoustic guitars in the 1850s.

It could be said, in a simplified version of events, that the steel string acoustic guitar is an American adaptation of the Spanish 'classical' gut string acoustic guitar, but with steel strings.

The advent of the steel string guitar also heralded substantial changes in the method of manufacture.

Generally Spanish built guitars were assembled 'as a whole'; that is, the neck component was included with the assembly of the resonant cavity.

By contrast the Martin company decided to build the body or resonant cavity of the instrument and to attach the neck by means of what is called a wedged dovetail joint.

The major components of the body or resonant cavity of an acoustic guitar include:

a front panel, often referred to as the top, face or soundboard;

a back panel; and a side wall, extending between the peripheries of the front and back anels.

To the top of the neck component, or arm of the guitar, is affixed a 'fingerboard', which allows the player to 'fret' or play notes.

The 'headstock' or 'peg head' of the guitar is at an end of the neck opposite to the end joined to the body and provides an area where string tension adjustment devices are affixed. These devices are known as the 'tuning keys' or 'machine heads'.

Between the headstock and the end of the fingerboard is the 'nut'. The strings rest on the 'nut' at the peg head end of the guitar and are affixed to the face or top of the guitar by the 'bridge'.

The 'bridge' is a wooden component, which is attached/adhered to the face or soundboard of the instrument and which provides the anchor point for the string ends.

The 'saddle' is 'let in' to a slot in the bridge and is usually kept in place by string pressure. The saddle is positioned to give the appropriate string length in order that the strings 'intonate' or resonate at the desired frequencies. The strings oscillate when played or strummed between the 'nut' and the 'saddle'.

The Current Assembly Method

Timber is sawn and sanded into thin sections, the back and top generally to 2.8 to 3.2 mm, and the sides: 1.8 to 2.2 mm.

Since the top or soundboard, is thin and would not be able to withstand the compressive force of the strings, which at concert pitch where the 'A' string is tuned to 440 KHz, is around 70 kg for the collective 6 strings fitted to a 'normal' acoustic guitar, the soundboard needs to be 'braced' or 'strutted'.

Longitudinal sections of timber are adhered to add strength. These pieces of timber are usually around 6 to 8 mm in width and 10 to 15 mm in height and are adhered onto the inner surface of the soundboard in the shape of an 'X', and are therefore often referred to as 'X' braces.

The back of the guitar is usually strengthened by four pieces of timber of similar or larger dimension to those adhered to the top, running across, from one side to the other of the instrument. These pieces are referred to as 'back braces'.

Since the sides are 1.8 to 2.2 mm in thickness and need to be adhered to the top and back, the gluing surface needs to be increased. This is achieved by the addition of 'kerfing'. Kerfing is a length of timber equal to the length of the sides, generally triangular in cross section, 5 to 10 mm in height and 5 to 10 mm in width. In order that the kerfing is able to conform to the curvaceous shape of the sides, it is cut almost through, by means of a saw, at regular intervals of around 10 to 15 mm. Since the space left in timber by a saw blade is called the 'kerf', it follows that this 'component' has become known as 'kerfing'.

The kerfing is clamped and adhered to the top and bottom of the sides to increase the surface area in anticipation of the adhesion of the top and the back.

Kerfing is extremely difficult to adhere exactly flush to the sides of the guitar and therefore there is generally an additional operation involved to mill or sand the sides and top of the kerfing to the same level.

The sides of an acoustic guitar are steam bent to the required and typical shape by the use of a heated press (which emulates the finished shape of the guitar) or heating irons, in conjunction with water. In some instances the timber, which will comprise the sides, is soaked in a bath and in other instances it is simply 'wetted down' with a sponge.

The sides, along with the kerfing, are clamped into jigs or 'forms' that match the top profile, plan view or shape of the guitar.

Once the sides are milled or sanded to an exact shape so that the top and bottoms of the sides are 'flush' with the kerfing, the top and back are adhered. The braces or struts on the face and back are trimmed 'by hand' to fit in, or to be 'housed', or to be flush with the kerfing.

The top and the back components are generally cut to a similar shape to the top profile or plan view of the body, but around 2 to 5 mm oversize or overlapping to ensure fitment. Later, the back and top are 'trimmed' to be flush with the sides. This is done as it is unlikely that the thin sections of timber that comprise the sides will exactly conform to the jigs or 'forms' into which the sides are temporarily fitted.

The 'body jigs' or 'forms' are removed once the face and back have been adhered, as the body or resonant cavity will then have its own 'structural tenacity'.

Internal and at the front of the body, a timber block is adhered to accept the fitting of the neck or arm component.

The methods for neck fitment vary: some makers and manufacturers use a method known as a 'dovetail' joint, which is well known in the wood working industry, others affix it by the use of wooden dowels, a method also well known in the woodworking industry and some affix the neck by the use of nuts and bolts.

The neck needs to be attached with great accuracy otherwise the instrument may not be easily played.

Difficulties arise in maintaining the accuracy of the resonant cavity or body, considering that:

the body is comprised of thin sections (1.8 to 2.2 mm) of timber, which therefore do not have integral structural tenacity;

the kerfing needs to be machined to conform to the top and bottom of the sides yet the sides are difficult to clamp or secure, and do not readily provide a clear datum from which they can be machined;

the thin sections of timber and manner of construction allow the timber to be prone to climatic variations, which in turn jeopardises accurate assembly.

Various makers and manufacturers have various equipment and methods of fitting the neck. It is generally a major piece of equipment and the process is often time consuming requiring considerable expertise to perform.

The bridge and 'saddle' assembly of the guitar is and needs to be 10 to 15 mm in height in order that the strings are able to exert enough pressure on the face to ensure good sound transference and to ensure that the strings are a sufficient distance from the face to enable the instrument to be played.

This height requirement means that the neck is 'set', attached or affixed at an angle back of a few degrees as observed in a side profile view of the instrument.

The obtuse angle makes the manufacturing process complex, and the need for manual adjustment considerable. Such adjustment usually occurs at many stages of production.

Since the advent of CNC routers it has been possible to produce components for musical instruments more accurately and yet, other than the efficiency of individual component manufacture, the improvement in quality and efficiency of instrument assembly has been minimal. Thus, there remains a need for methods and apparatus which improve on conventional techniques.

SUMMARY OF THE INVENTION

One aspect of the present invention accordingly provides a method of assembling a musical instrument, the instrument having a major panel and a side wall, the major panel including a groove or rebate cut into the panel according to a predetermined pattern, the method including the steps of:

providing a first assembly jig adapted to support the panel;

laying the panel on the first jig;

providing a second assembly jig adapted to hold the side wall in a configuration corresponding to the predetermined pattern of the groove or rebate;

placing the side wall into the second jig such that a free edge of the side wall follows the predetermined pattern;

applying adhesive to the groove or rebate;

bringing the jigs together such that the free edge of the side wall is inserted into the groove or rebate, and applying a compression force across the first and second jigs to urge the side wall into the groove or rebate.

The predetermined pattern of the groove or rebate is preferably configured such that the groove or rebate extends substantially around the periphery of the panel.

Any appropriate adhesive may be used to adhere the free edge of the side wall to the groove or rebate.

The major panel may be a front (or top or face) panel of the instrument, also referred to as a soundboard in an acoustic guitar, or it may be a back panel of the instrument.

The instrument may include a neck component projecting in a direction away from the side wall and extending substantially parallel to the major panel. In that event, the first assembly jig may also be adapted to support the neck in a predetermined orientation relative to the major panel. The method may then include a step of laying the neck on the first jig such that a base part of the neck overlies a part of the major panel and can be adhered to the major panel. The method may also include a step of adhering the side wall to a side portion of the neck.

The musical instrument may include a second major panel. The second panel may also include a groove or rebate cut into the panel and, preferably, this groove or rebate has the same predetermined pattern as the groove or rebate in the first major panel. The method may then include steps of:

removing the second jig from the side wall;

applying adhesive to the groove or rebate of the second major panel;

placing the second major panel onto an edge of the side wall;

providing a third assembly jig adapted to engage the second major panel;

placing the third jig over the second panel; and applying a compression force across the first and third jigs to urge the first major panel, the side wall and the second major panel together.

If the first major panel is a front panel of the instrument, the second panel may be the back panel.

The steps of the method need not be performed in the aforementioned order. Indeed, the second panel may be placed into the third jig before being presented to the edge of the side wall. Also, it is preferable to fabricate each of the components before the assembly steps are commenced.

The method may also include a step of removing excess material from the first and/or second major panel after being adhered to the side wall.

A further aspect of the invention provides a musical instrument including a major panel and a side wall, the major panel having a groove or rebate cut into the panel according to a predetermined pattern, and an edge of the side wall being secured within the groove or rebate.

A further aspect of the invention provides a musical instrument including a major panel and a side wall, the major panel having a groove or rebate extending substantially around its periphery and an edge of the side wall being secured within the groove or rebate.

Another aspect of the invention provides a method of assembling a musical instrument, the instrument having a front panel, a back panel and a side wall extending there between, the front and back panels each having a groove or rebate extending substantially around its periphery for receiving an edge of the side wall, the method including the steps of:

placing adhesive into each groove or rebate;

inserting opposing edges of the side wall into the grooves or rebates of the front and back panels; and applying a compression force to urge the panels and side wall together.

Another aspect of the invention provides an assembly jig to facilitate assembly of a musical instrument having a major panel and a side wall, the major panel including a groove or rebate cut into the panel according to a predetermined pattern, the jig being adapted to hold the side wall in a configuration corresponding to the predetermined pattern so as to facilitate insertion of a free edge of the side wall into the groove or rebate.

The predetermined pattern of the groove or rebate is preferably configured such that the groove or rebate extends substantially around the periphery of the panel.

Preferably the assembly jig includes means for holding the side wall in an orientation perpendicular to the orientation of the panel. The holding means may include pairs of pins configured to extend alongside the side wall to hold it in a fixed orientation.

Another aspect of the invention provides an assembly jig to facilitate assembly of a musical instrument having a major panel and a neck component, the jig including first locating means for positively positioning the major panel on the jig and second locating means for positively positioning the neck on the jig, whereby the neck becomes positively positioned with respect to the major panel.

A side wall and a second major panel of the instrument may also be secured to the first major panel whilst the first panel is positioned in the assembly jig. The assembly jig may also include resilient clamping devices for applying a compression force to urge the second panel, the side wall and the first panel together.

Another aspect of the invention provides a method of making a panel for a musical instrument, the method including the steps of providing a sheet of material; and cutting a groove or rebate substantially around a periphery of the sheet for receiving an edge of a side wall of the instrument.

A further aspect of the invention provides a panel for a musical instrument, the panel having a groove or rebate extending substantially around its periphery for receiving an edge of a side wall of the instrument.

Another aspect of the invention provides a method of making a panel for a musical instrument, the method including the steps of providing a substantially uniformly thick sheet of material; and routing excess material from the sheet using a computer controlled machine so as to produce a panel having an edge portion which is thicker than a centre portion.

Typically the material would be timber but it is possible that other materials may be used.

The method may also include a step of cutting a groove or rebate into the edge portion for receiving an edge of a side wall of the instrument.

The method may further include a step of routing the thickness of the sheet to adjust the acoustic characteristics of the panel. The panel may accordingly be sculpted to achieve desired performance characteristics Using a computer controlled machine, such as a CNC machine, achieves this accurately and on a repeatable basis. Also, the sheet may be routed (carved) in such a way as to leave strengthening portions in the panel, equivalent to the strengthening braces which are applied to the internal surfaces of the soundboard and back panel of a conventional acoustic guitar. However, using this aspect of the present invention, some or all of the strengthening "braces" are formed integrally with the panel. This has acoustic benefits as well as manufacturing benefits, in that far less time is required.

A further aspect of the invention provides a panel for a musical instrument, the panel having an edge portion which is thicker than a centre portion and having a groove or rebate extending substantially around its periphery for receiving an edge of a side wall of the instrument.

Another aspect of the invention provides a musical instrument including a major panel and a side wall, the major panel having an edge portion which is thicker than its centre portion and having a groove or rebate extending substantially around its periphery, an edge of the side wall being inserted within the groove or rebate.

It can be seen that the above noted aspects of the invention together provide a methodology which substantially improves the assembly time and structural tenacity of the instrument, therefore improving performance or acoustic efficiency. Acoustic efficiency is the ability of the instrument to transmit sound into the atmosphere.

Embodiments of the invention provide an integrated clamping jig, comprising:

Face layout and location,

Neck layout and location on the 'Assembly Jig'

'Tap handle' spring loaded clamps that are easily removable

Simple frame, which can (a) hold, clamp the sides into an accepting groove or rebate in the face and a groove in the neck. 'Side Holding Jig'

The frame is 'open', allowing the assembler to have access to the inside of the guitar in order to attend to fitment and to clean away any excessive adhesive.

And (b), when the adhesive has dried, or 'flashed off' in affixing the sides to the neck and face or top, a frame can be used to clamp the back panel in place allowing it to be adhered to the sides. This may be referred to as the 'Back Platen'.

BRIEF DESCRIPTION OF THE DRAWINGS

To assist the further understanding of the invention, reference is now made to the accompanying drawings which illustrate preferred embodiments. It is to be appreciated that these embodiments are given by way of illustration only and the invention is not to be limited by this illustration.

DETAILED DESCRIPTION OF PREFERRED EMBODIMENTS

Figure 1:
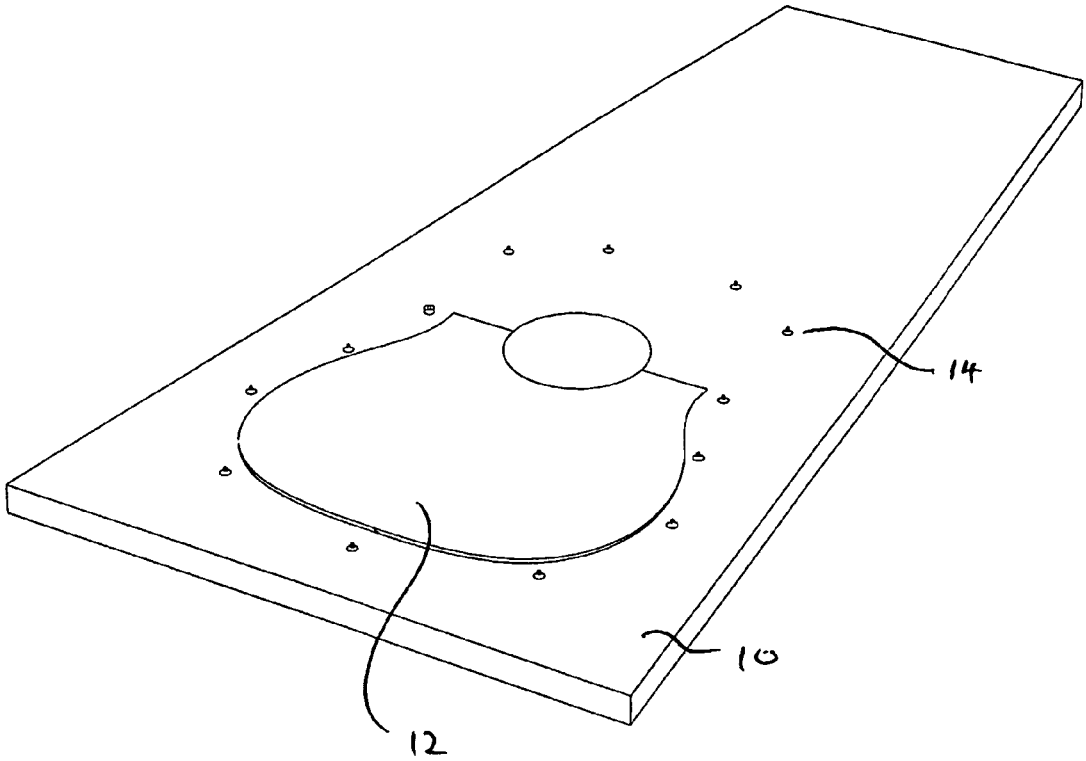
FIG. 1 shows a perspective view of a main assembly jig.

Referring now to the drawings, FIG. 1 shows a perspective view of a first assembly jig, being a main assembly jig 10, for the purposes of assembling a musical instrument such as an acoustic guitar. The main assembly jig 10 is substantially planar but includes a tilted face portion 12 at the bottom end thereof so as to provide a bend in the front face of the assembled guitar. This is required to provide the necessary "action". The action is the distance between the strings and the frets at a given point along the fingerboard. The main assembly jig 10 also includes attachment points 14 for elasticated clamping devices (not shown for the sake of clarity).

Figure 2:
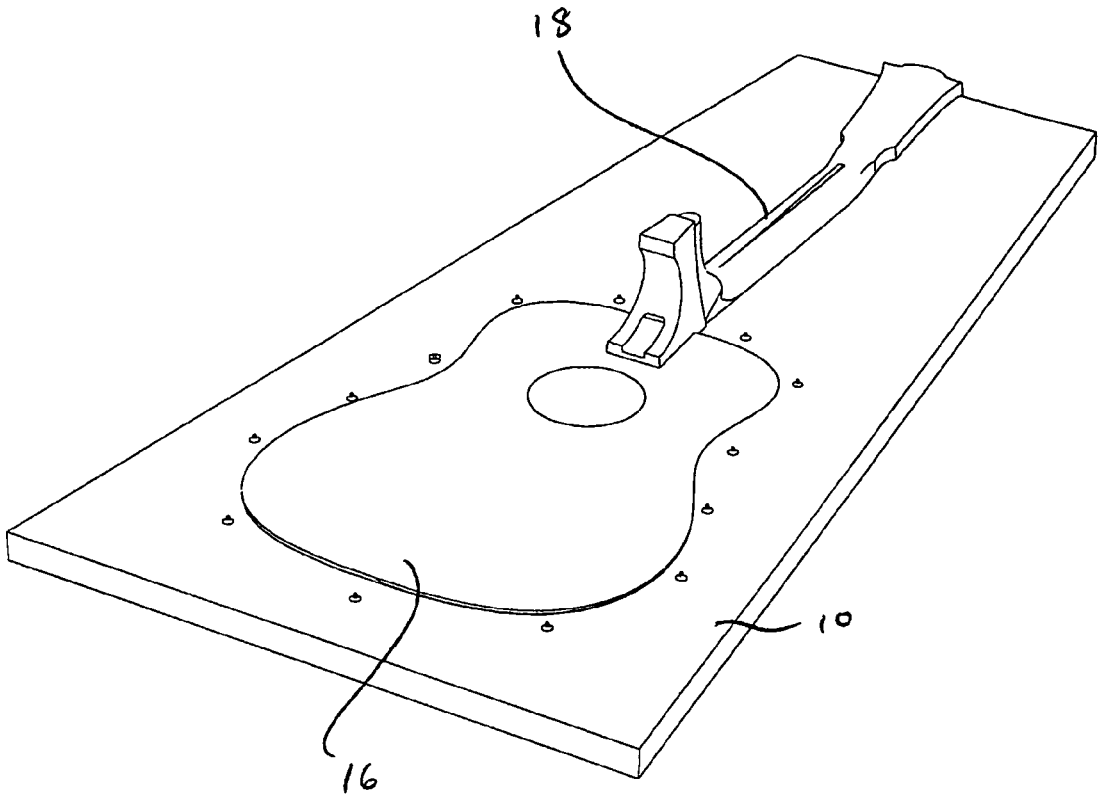
FIG. 2 shows a front panel (or soundboard) and neck component of a guitar overlying the main assembly jig of FIG. 1.

FIG. 2 shows the main assembly jig 10 but with a soundboard 16 and neck component 18 of the guitar in place. The soundboard 16 is the first component to be placed on the jig (face down) and it is located by four pins (not shown). The pins are situated where the bridge will eventually be secured and where the base of the neck component 18 sits over the soundboard 16.

The neck component 18 is similarly positioned using locating pins (not shown) on the main assembly jig 10. At an earlier stage, the neck was milled or "housed" to fit over the soundboard panel of the instrument. Adhesive is applied to the milled area so that, as the neck is located, it is also adhered to the inside of the soundboard. The neck is held in position by pressure being applied to the neck and to the soundboard join area by means of two mechanical toggle clamps.

Because both the soundboard 16 and the neck 18 are fixed in position relative to the main assembly jig 10, their positions are also fixed relative to each other. Thus, accurate fitment of the neck 18 to the body of the instrument is assured. This is in vast contrast to conventional techniques for fixing a neck to an instrument body.

Figure 3:
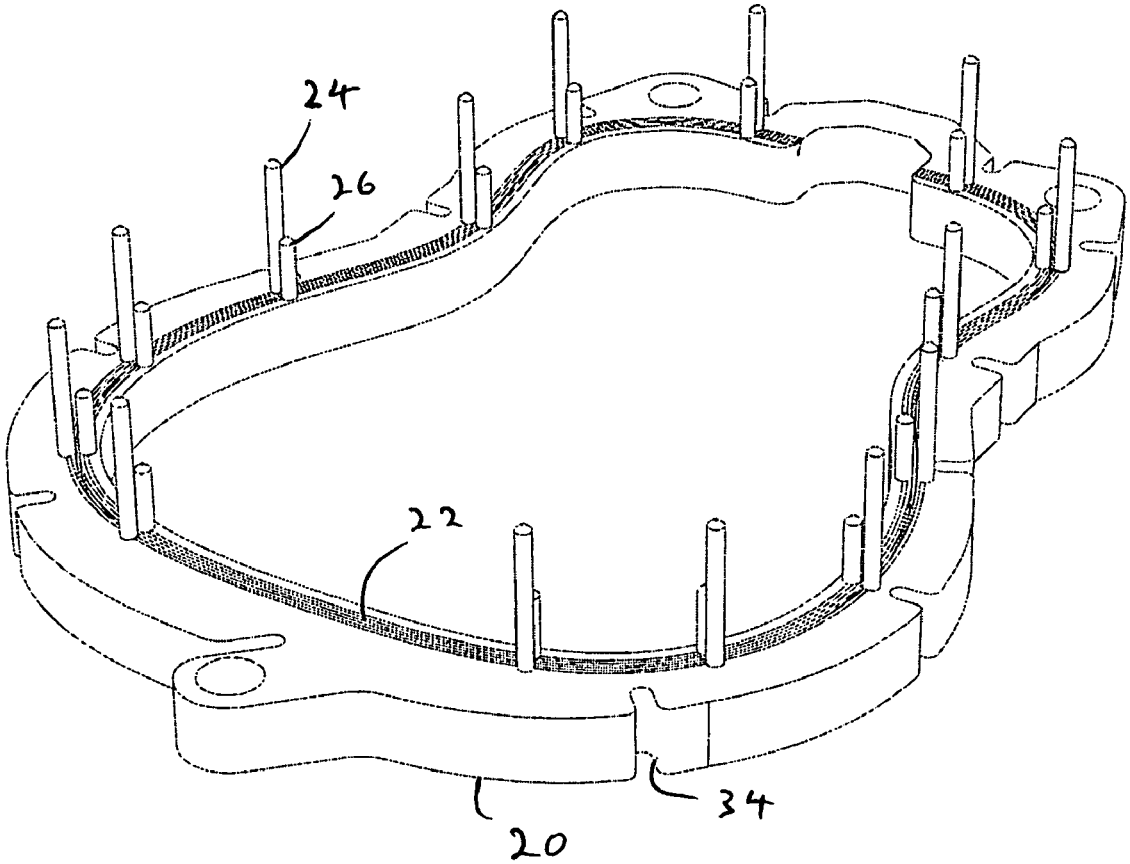
FIG. 3 shows a perspective view of a "side holding jig" for holding the side wall(s) of a guitar.
Figure 4:
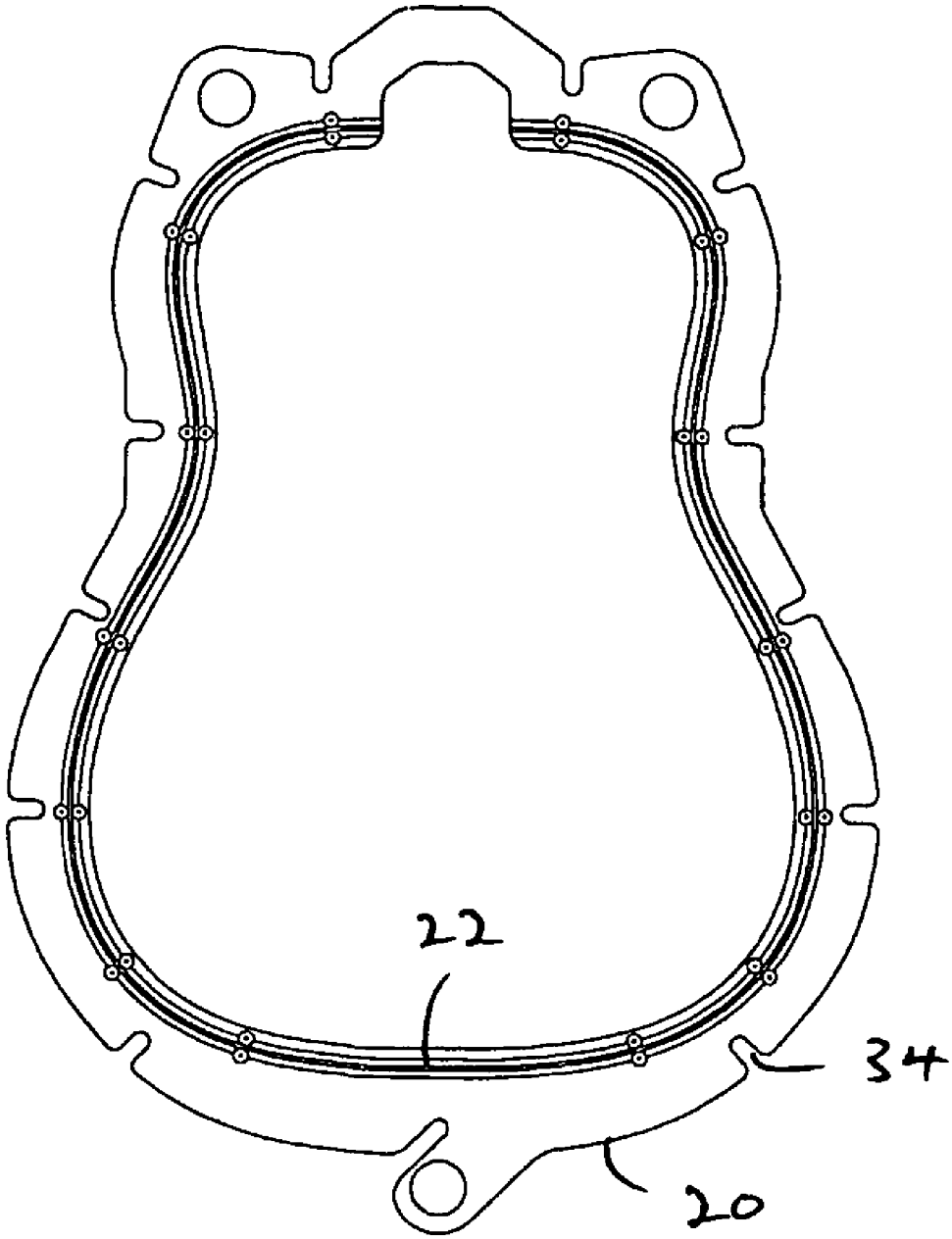
FIG. 4 shows a plan view of the side holding jig of FIG. 3.

FIGS. 3 and 4 show a second assembly jig, being a side holding jig 20. This jig includes a groove 22 adapted to hold an edge of the side wall of the instrument. To keep the side wall "plumb", i.e. perpendicular to the face of the side holding jig 20, a plurality of pairs of support pins 24, 26 are provided. It will be appreciated however that alternative means for supporting the side walls may be employed.

Figure 5:
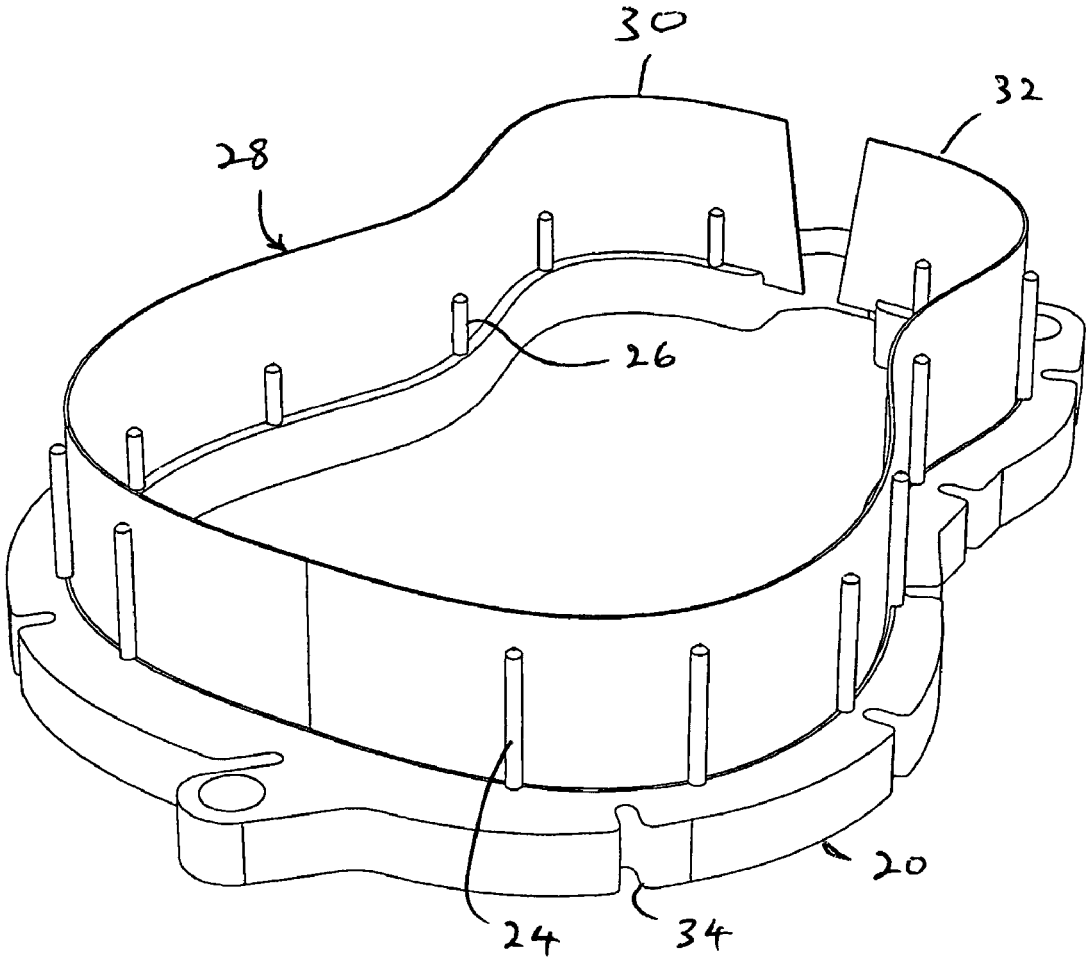
FIG. 5 shows a side wall of a guitar held within the side holding jig of FIG. 3.

FIG. 5 shows a side wall 28 located within the side holding jig 20. It can be seen in FIG. 5 that the wall 30 is held between the inner locating pins 26 and the outer locating pins 24.

The groove 22 and position of the side wall support pins 24, 26 conform to a predetermined shape corresponding to the desired shape of the finished instrument.

It is usual for the side wall 28 of an acoustic guitar to have two separate side portions 30 and 32. The sides 30, 32 were steam bent to shape (in a manner similar to the traditional method) at a prior stage. They are then joined in the side joining jig 20 by adhering them to a body block (not shown).

Figure 6:
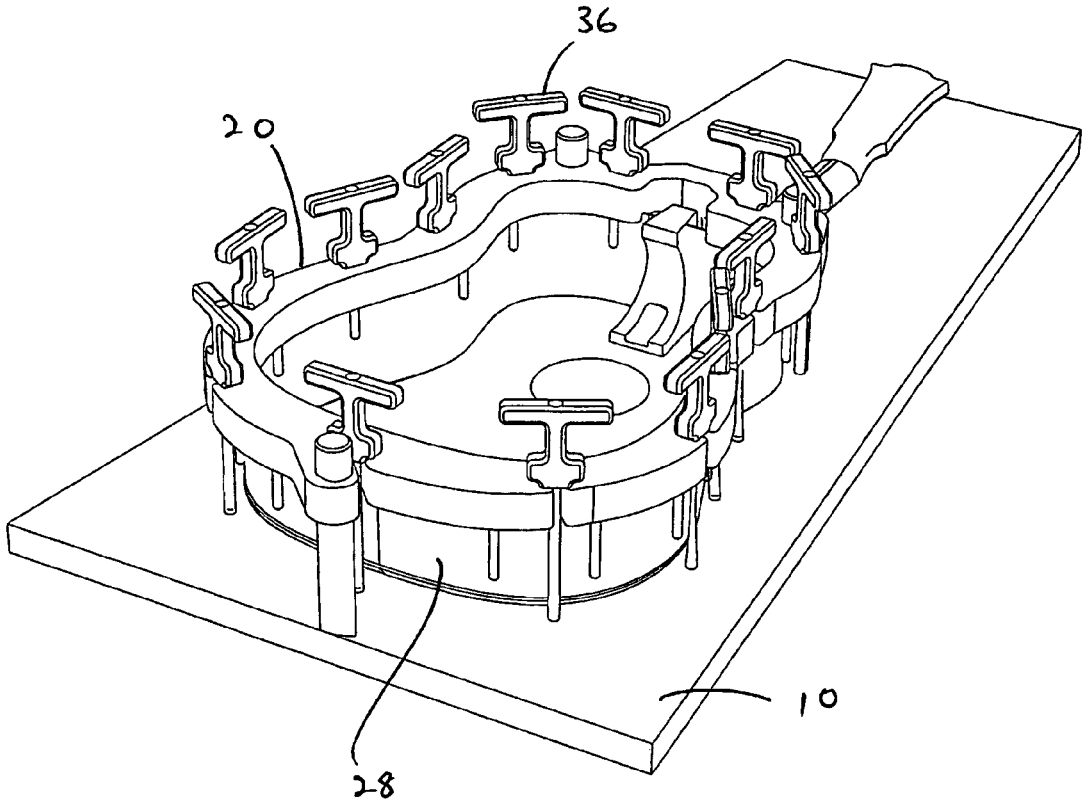
FIG. 6 shows a perspective view of the side wall being secured to the front panel and neck component by means of a compression force applied across the main assembly jig and side holding jig.

Adhesive is applied to rebates or grooves cut in the perimeter of the soundboard 16 and on the sides of the neck 18. The side holding jig 20 is then turned over and the edges of the sides 30, 32 are located in the grooves or rebates as shown in FIG. 6. The side holding jig 20 includes slots 34 (FIG. 5) along its perimeter allowing the elasticated clamps 36 to apply pressure to the positioned sides 30,32 and soundboard 16 until such time as the adhesive bonds.

Grooves are milled or sawn down the sides of the neck 18 (possibly in an earlier operation) into which the sides 30, 32 are fitted. The sides 30, 32 are fixed to the soundboard 16 and the end portions of the sides 30, 32 slide into the grooves sawn down the side of the neck 18.

Figure 7:
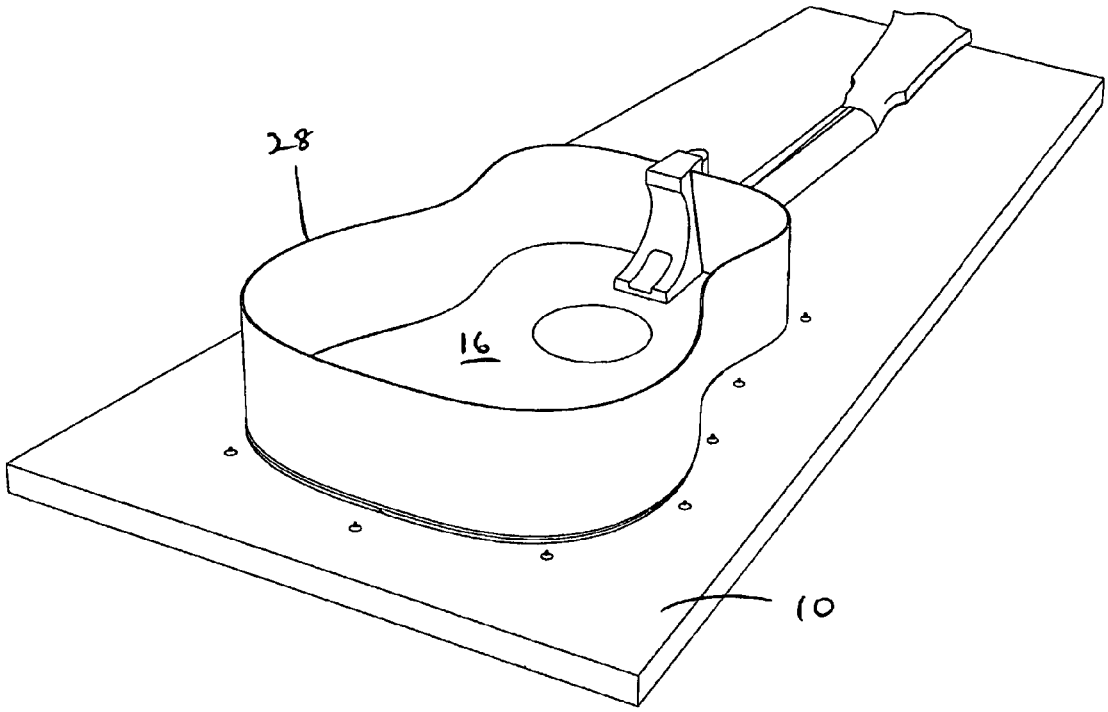
FIG. 7 shows a perspective view of the side wall secured to the front panel and neck with the side holding jig removed.

Once the adhesive has secured the sides 30, 32 to the soundboard 16 and to the neck 18, the side holding jig 20 is unclamped and removed leaving a partially assembled instrument as shown in FIG. 7 (clamps 36 omitted for clarity).

Figure 8:
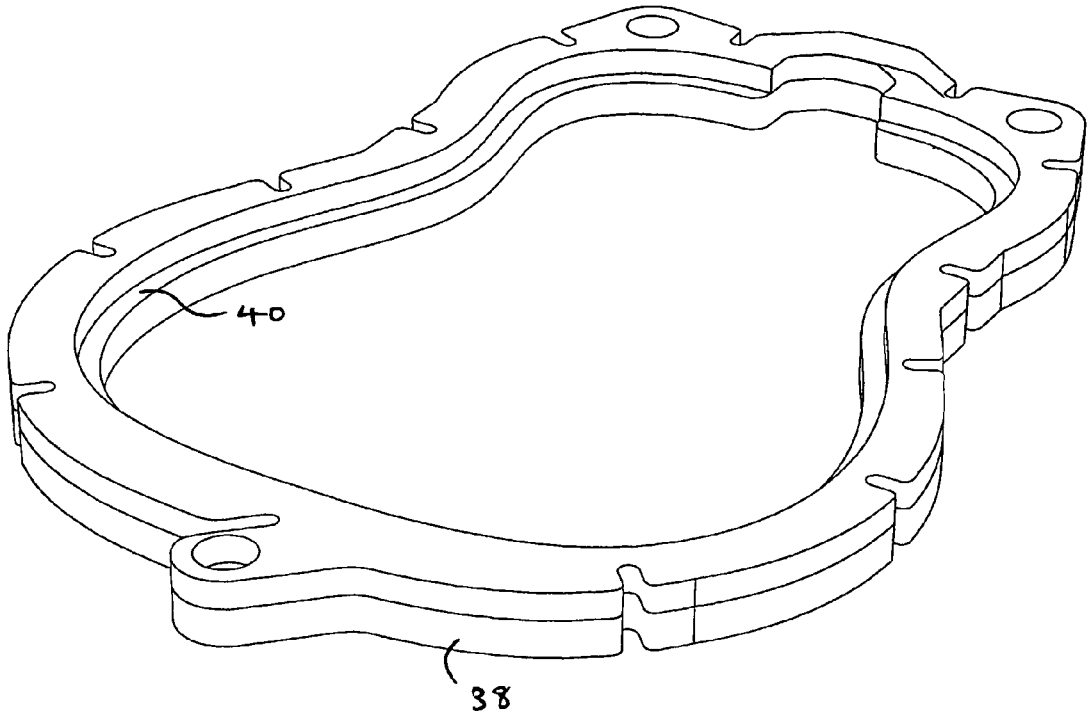
FIG. 8 shows a perspective view of a back platen for holding the back panel of the guitar.
Figure 9:
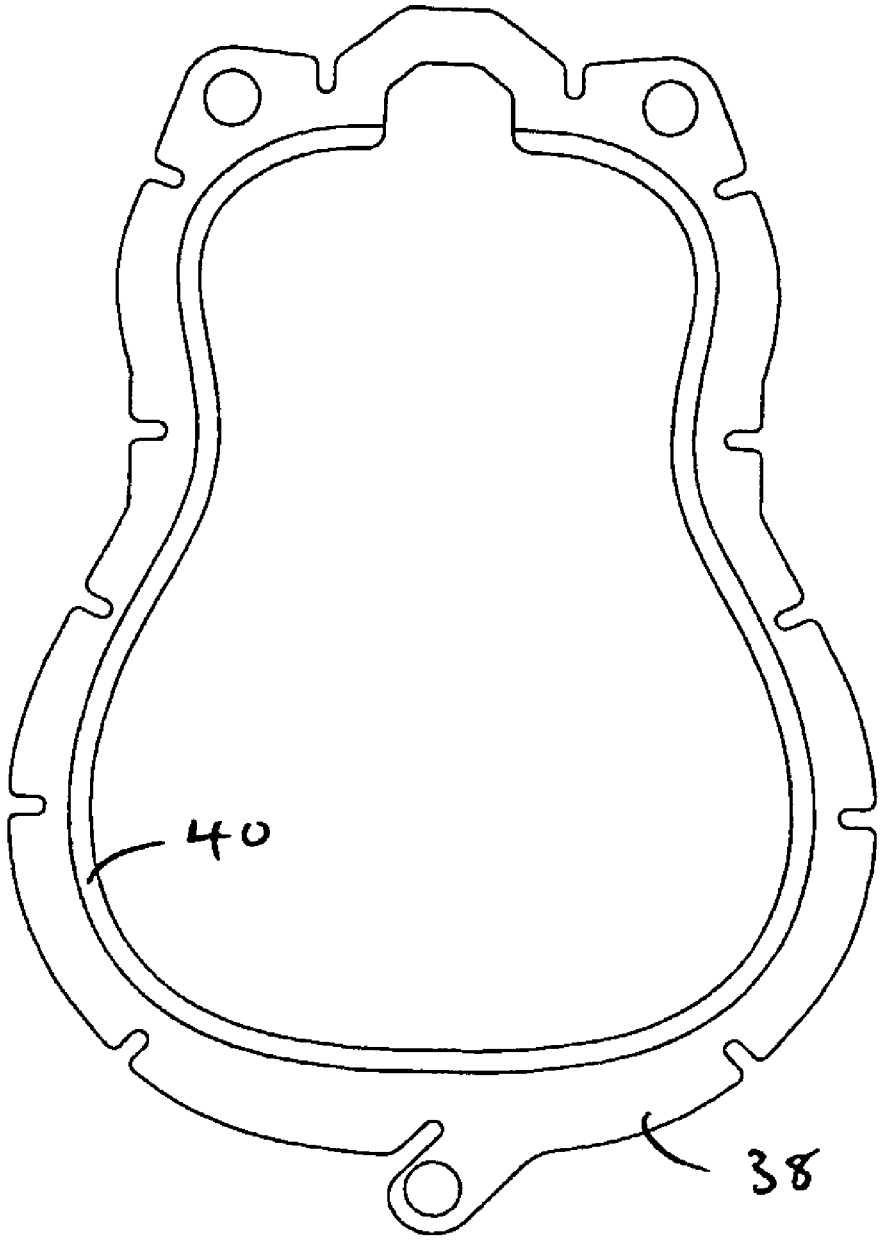
FIG. 9 shows a plan view of the back platen of FIG. 8.

FIGS. 8 and 9 show a third assembly jig, in the form of a back platen 38, which is of a similar shape to the side holding jig 20 but includes a rebate 40 for holding a back panel 39 of the instrument rather than a groove 22 as in the side holding jig 20 shown in FIGS. 3 and 4, and it does not include side support pins as in the side holding jig 20.

Figure 10:
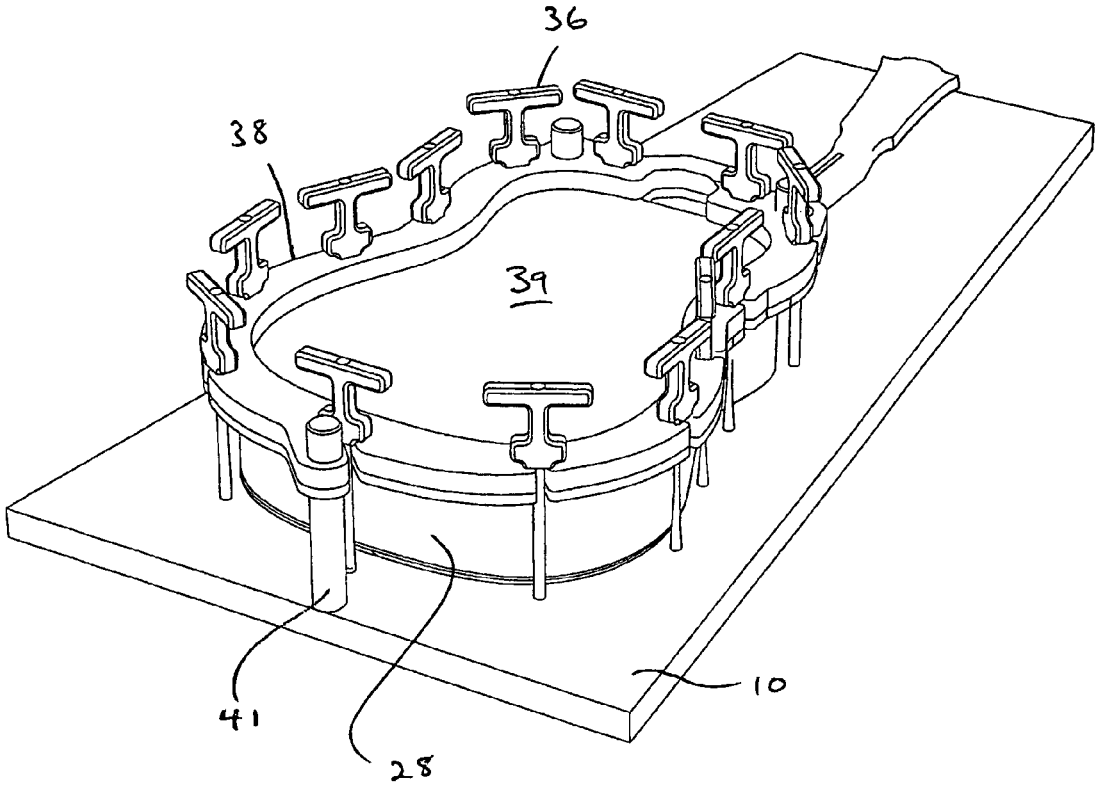
FIG. 10 shows the back panel being secured to the side wall by means of a compression force applied across the back platen and the main assembly jig.

The back panel 39 is then placed in the back platen 38 and adhesive is applied to grooves or rebates provided on the perimeter of the back panel 39 into which the side walls 30, 32 will locate. The back platen 38 is then positioned on locating dowels 41 (FIG. 10) on the main assembly jig 10. The back platen 38, together with the back panel 39, is then clamped into place on the side walls 30, 32 by means of the elasticated clamps 36 as shown in FIG. 10. The main assembly of the acoustic guitar is then complete.

Figure 11A:
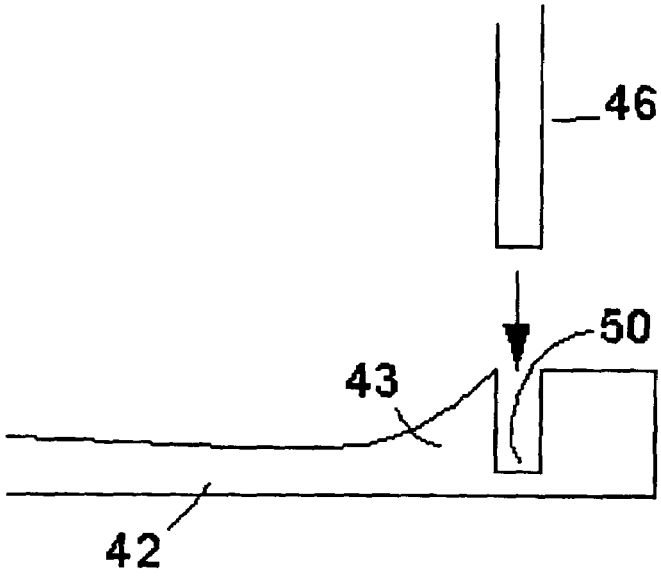
FIG. 11*a* shows a cross sectional view of an edge portion of a major panel, such as a face panel or back panel, and a side wall of a guitar.
Figure 11B:
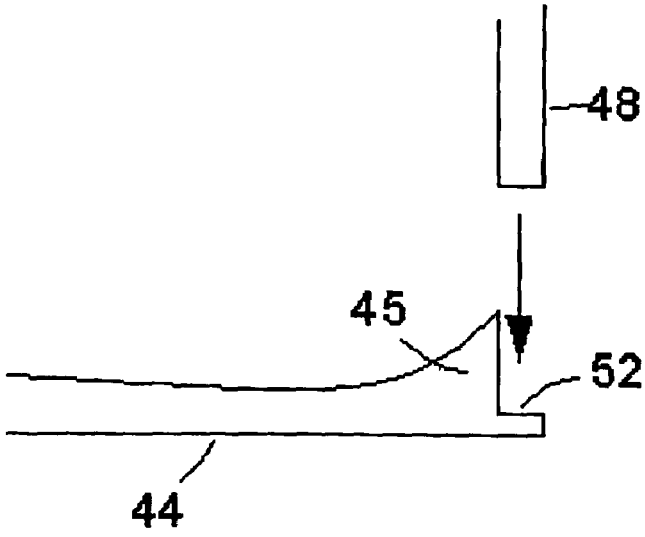
FIG. 11*b* shows a cross sectional view of an alternative edge portion of a major panel and a side wall of a guitar.

FIGS. 11*a* and 11*b* show edge portions of major panels 42, 44 such as a soundboard or back panel. Each of the panels 42, 44 may be machined from a single piece of timber or from a composite timber sheet. Side walls 46, 48 are also shown.

The features of the panels 42, 44 are accurately milled on a CNC router. The panels 42, 44 are left slightly thicker than their conventional counterparts, allowing a portion 43, 45 of the timber to remain. This portion fulfils the role of conventional kerfing, increasing the gluing surface.

A groove 50 is cut into the panel 42 (FIG. 11*a*) or a rebate 52 is cut into the panel 44 (FIG. 11*b*). The sides 46, 48 are later fixed and adhered to these grooves/rebates. In the case of a rebate 52, the joint created with the side wall 48 is referred to as a half housed joint.

An advantage of the present invention is that it provides a stronger, and possibly lighter, structure than using the traditional process. The improved strength also improves acoustic efficiency.

Another advantage of the present invention is that the soundboard and back panel of the instrument, while being machined, are presented to the CNC machine's tools in such a way that considerable internal shaping and optimising can be effected in minimal time and at minimal labour cost. This allows considerable and controllable improvement in sound quality and acoustic efficiencies.

All of the components can be laid out on the machine and produced in sequence: i.e. the soundboard, the neck, the side walls and the back panel. Each component has machined within it locating holes which allow the component to be positioned relative to other components or to one or more of the assembly jigs described.

This "following process" allows the operator to adjust tolerances by means of machine tool radius and tool length offsets to ensure that fitment is precise.

The accurate manufacture of components allows immediate and fluent assembly of the instrument in one half to a third of the time that has been possible using traditional methods of manufacture. For example, it has been found that a fully completed guitar may be produced in 2 to 2½ hours whereas an equivalent guitar would take 5 to 7 hours using traditional techniques. A further advantage of the invention is that it produces a much more consistent product than is possible using conventional techniques.

Although preferred embodiments of the invention have been described herein in detail, it will be understood by those skilled in the art that variations may be made thereto without departing from the spirit or scope of the invention as defined by the appended claims.

The claims defining the invention are as follows:

1. A method of assembling a musical instrument, the instrument having a first major panel and a side wall, the first major panel including a groove or rebate cut into the panel according to a predetermined pattern, the method including the steps of:

providing a first assembly jig adapted to support the panel;

laying the panel on the first jig;

providing a second assembly jig adapted to hold the side wall in a configuration corresponding to the predetermined pattern of the groove or rebate, the second assembly jig being separate from the musical instrument;

placing the side wall into the second jig such that a free edge of the side wall substantially follows the predetermined pattern;

applying adhesive to the groove or rebate;

bringing the jigs together such that the free edge of the side wall is inserted into the groove or rebate, and applying a compression force across the first and second jigs to urge the side wall into the groove or rebate.

2. The method of claim 1 wherein the predetermined pattern of the groove or rebate is configured such that the groove or rebate extends substantially around the periphery of the panel.

3. The method of claim 1 wherein the first major panel is a front panel of the instrument.

4. The method of claim 1 wherein the instrument includes a neck component projecting in a direction away from the side wall and at a predetermined orientation relative to the first major panel, wherein the first assembly jig is also adapted to support the neck component in said predetermined orientation, and wherein the method includes the steps of:

laying the neck component on the first jig such that a base part of the neck component overlies a part of the first major panel; and adhering the neck component to the first major panel.

5. The method of claim 4, further including the step of adhering the side wall to a side portion of the neck component.

6. The method of claim 1, further including the step of removing excess material from the first and/or second major panel after being adhered to the side wall.

7. A method of assembling a musical instrument, the instrument having a first major panel, a second major panel, and a side wall, the first major panel including a first groove or rebate cut into the first major panel according to a predetermined pattern and second major panel having a second groove or rebate cut into the second major panel, the second groove or rebate having the same predetermined pattern as the first groove or rebate, the method including the steps of:

providing a first assembly jig adapted to support the first major panel;

laying the first major panel on the first jig;

providing a second assembly jig adapted to hold the side wall in a configuration corresponding to the predetermined pattern of the first groove or rebate;

placing the side wall into the second jig such that a free edge of the side wall substantially follows the predetermined pattern;

applying adhesive to the first groove or rebate;

bringing the jigs together such that the free edge of the side wall is inserted into the first groove or rebate, applying a compression force across the first and second jigs to urge the side wall into the first groove or rebate;

removing the second jig from the side wall;

applying adhesive to the second groove or rebate of the second major panel;

placing the second major panel onto an edge of the side wall;

providing a third assembly jig adapted to engage the second major panel;

placing the third jig over the second panel; and applying a compression force across the first and third jigs to urge the first major panel, the side wall and the second major panel together.

8. The method of claim 7, wherein the second major panel is a back panel of the instrument.

9. A method of assembling a musical instrument, the instrument having a first major panel and a side wall, the first major panel including a groove or rebate cut into the panel according to a predetermined pattern, the method including the steps of:

providing a first assembly jig adapted to support the panel;

laying the panel on the first jig;

providing a second assembly jig adapted to removably retain the side wall in a configuration corresponding to the predetermined pattern of the groove or rebate;

placing the side wall into the second jig such that a free edge of the side wall substantially follows the predetermined pattern;

applying adhesive to the groove or rebate;

bringing the jigs together such that the free edge of the side wall is inserted into the groove or rebate, and applying a compression force across the first and second jigs to urge the side wall into the groove or rebate.

* * * * *